United States Patent [19]

Collipp

[11] Patent Number: 4,591,295

[45] Date of Patent: May 27, 1986

[54] CURVED CONDUCTOR WELL TEMPLATE

[75] Inventor: Bruce G. Collipp, Houston, Tex.

[73] Assignee: Shell Offshore Inc., Houston, Tex.

[21] Appl. No.: 679,845

[22] Filed: Dec. 10, 1984

[51] Int. Cl.[4] ..... E02B 17/00

[52] U.S. Cl. ..... 405/195; 175/7; 175/9; 405/224

[58] Field of Search ..... 405/195–199, 405/203–209, 224–227; 175/5, 7, 9; 166/350, 359, 367

[56] References Cited

U.S. PATENT DOCUMENTS

| | | | |
|---|---|---|---|
| 3,605,668 | 9/1971 | Morgan | 175/7 X |
| 3,670,507 | 6/1972 | Mott et al. | 175/9 X |
| 3,672,177 | 6/1972 | Manning | 175/7 X |
| 3,754,403 | 8/1973 | Mott et al. | 405/196 |
| 3,899,032 | 8/1975 | Rees et al. | 175/9 |
| 4,030,310 | 6/1977 | Schirtzinger | 405/195 |
| 4,053,022 | 10/1977 | Mercier | 175/7 X |
| 4,136,996 | 1/1979 | Burns | 405/195 |

*Primary Examiner*—Dennis L. Taylor

[57] ABSTRACT

An anchored submerged marine structure commonly referred to as a well template is located at the bottom of a body of water and used in the directional drilling of underwater wells. The well template carries curved well conductors, each conductor capable of deviating well drilling equipment passed through the conductor so that each well may reach reservoirs located a further distance away from the template. The template's upper surface is formed to aid in the installation of the well conductor through the template.

17 Claims, 2 Drawing Figures

CURVED CONDUCTOR WELL TEMPLATE

BACKGROUND OF THE INVENTION

1. Field of the Invention

The invention relates to the drilling of wells offshore; and, more particularly, to a method and apparatus for producing hydrocarbons from subterranean formations under the ocean floor.

2. Description of the Prior Art

In an attempt to locate new oil fields, an increasing amount of well drilling has been conducted at offshore locations, such as off the coasts of California, Louisiana, and Texas, and more recently, off the coast of Alaska and in the North Sea. Generally, well drilling structures used at these locations are installed above the surface of the offshore body of water, these structures being supported by columnar frames extending downward to the bottom of the body of water. Straight well conductors generally comprising hollow sections of pipe are extended from these well drilling structures some distance below the ocean floor. These conductors provide guidance and support for tubular well drilling equipment carried within these conductors and used for drilling into hydrocarbon bearing reserves.

As the water depths of the drilling operations increase the cost of these bottom supported well drilling structures becomes prohibitive. For this reason, Tension Leg Platforms, comprising moored floating vessels, or dynamically positioned floating vessels are used in these greater water depths. Wells drilled from these devices are guided through a well conductor template placed below these devices on the ocean floor. This template, generally a massive structure, allows the placement of straight well conductors down through well conductor guides carried by the template, such as disclosed in FIG. 1 of U.S. Pat. No. 4,198,179, entitled "Production Riser," filed Aug. 11, 1978 and issued Apr. 15, 1980 to Floyd T. Pease, et al.

As can be imagined, these structures are expensive, and the number of hydrocarbon bearing reservoirs that may be laterally reached beneath each structure needs to be maximized. But the lateral reach of the well conductors is limited by the vertically oriented well conductor guides carried by the well template. Since the well conductors pass vertically through the well template, wells drilled through these well conductors cannot developed an angle of inclination sufficient to reach distant hydrocarbon bearing formations.

To increase the lateral reach of the wells drilled from the bottom supported marine structures mentioned earlier, curved well conductors were sometimes used as is disclosed in U.S. Pat. No. Re. 28,860, entitled "Curved Offshore Well Conductors", reissued June 15, 1975 to Peter W. Marshall et al. By curving these conductors, the well drilling equipment could develop an angle of inclination from the vertical before leaving the curved conductor. Since the drilling equipment would also develop an early angle of inclination, more distant reservoirs located at a greater lateral distance beneath the marine drilling structure could be reached.

It would be desirable therefore, to also incorporate these curved well conductors into the well templates in order to maximize the lateral reach of the well drilling equipment.

But the probability of successfully aligning and installing curved well conductors into a well template located a substantial distance below a floating drilling vessel must be viewed with apprehension. Poor visibility and strong currents, as well as roll, pitch, heave, and sway of the surface vessel must necessarily complicate the operation.

A method and apparatus needs to be developed which allows the installation of curved well conductors into a subsea well template, in order to maximize the possible economic recovery of hydrocarbon reserves located beneath these well templates.

SUMMARY OF THE INVENTION

The present invention describes a method and apparatus to be used in the installation of curved well conductors into a subsea well template. The upper surface of the well template incorporates an arrangement of cooperating surfaces that aids in aligning and guiding the lower end of the curved well conductor towards a conductor guide opening located through the upper surface of the well template.

Specifically, the Well Template apparatus of the present invention, comprises, well conductor movement limiting means formed by a substantial portion of the upper surface of the well conductor template, said surface arranged to prevent, during installation of at least one well conductor, said well conductor from downward vertical movement and lateral movement toward the vertical central axis of said well template, and curved conductor guide means carried by said conductor template and forming an opening curved therethrough, for slideably receiving a well conductor passed downwardly therethrough.

More specifically, the method of the present invention for producing hydrocarbons from a subterranean hydrocarbon-bearing formation located beneath the floor of a body of water comprises the steps of; installing a well conductor template having a vertical central axis, said template carrying at least one curved conductor guide means, on the floor of said body of water above said formation, lowering a well conductor downwardly through said body of water, the well conductor contacting well conductor movement limiting means formed by a substantial portion of the upper surface of said well template, thereby preventing said well conductor from downward vertical movement and lateral movement toward the vertical central axis of said well template, aligning the lower end of said well conductor with an open upper end of said curved conductor guide means, extending said well conductor downwardly with respect to said well conductor template, through said curved conductor guide means, thereby curving said conductor outwardly and downwardly through said template in a manner maintaining a relatively smooth bore throughout substantially the entire extent of said conductor, drilling a well via said conductor down through said floor and into fluid communication with said formation, and producing formation fluids from said formation via said well conductor.

An object of the present invention is to install curved well conductors in subsea well templates. A further object is to simplify the installation of these conductors into the subsea template.

These and other features and advantages of the present invention will become apparent from the following detailed description, wherein reference is made to the Figures in the accompanying drawings.

DESCRIPTION OF THE PREFERRED EMBODIMENT

Figure 1:
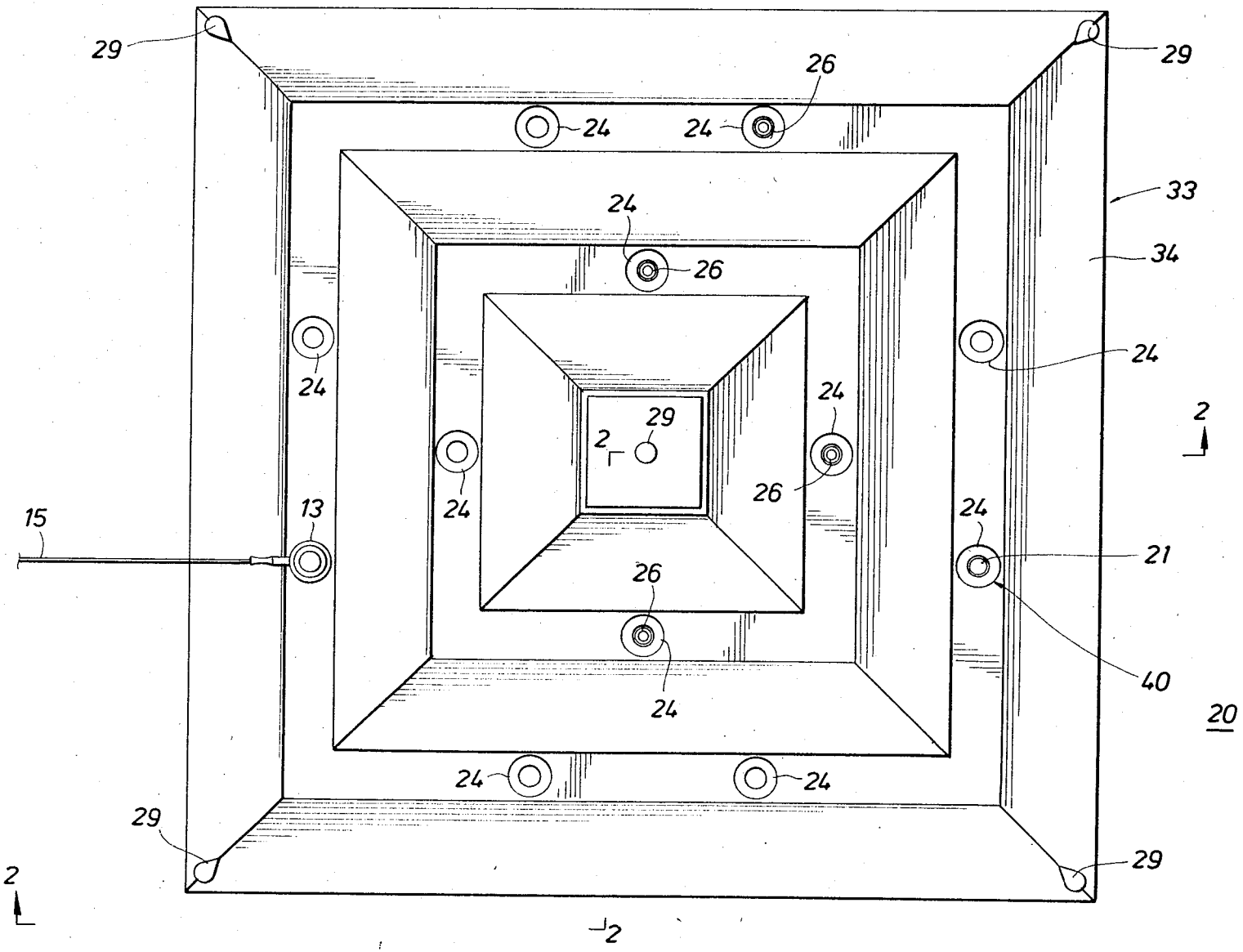
FIG. 1 is a plan view of a subsea well template located on a bottom of a body of water.
Figure 2:
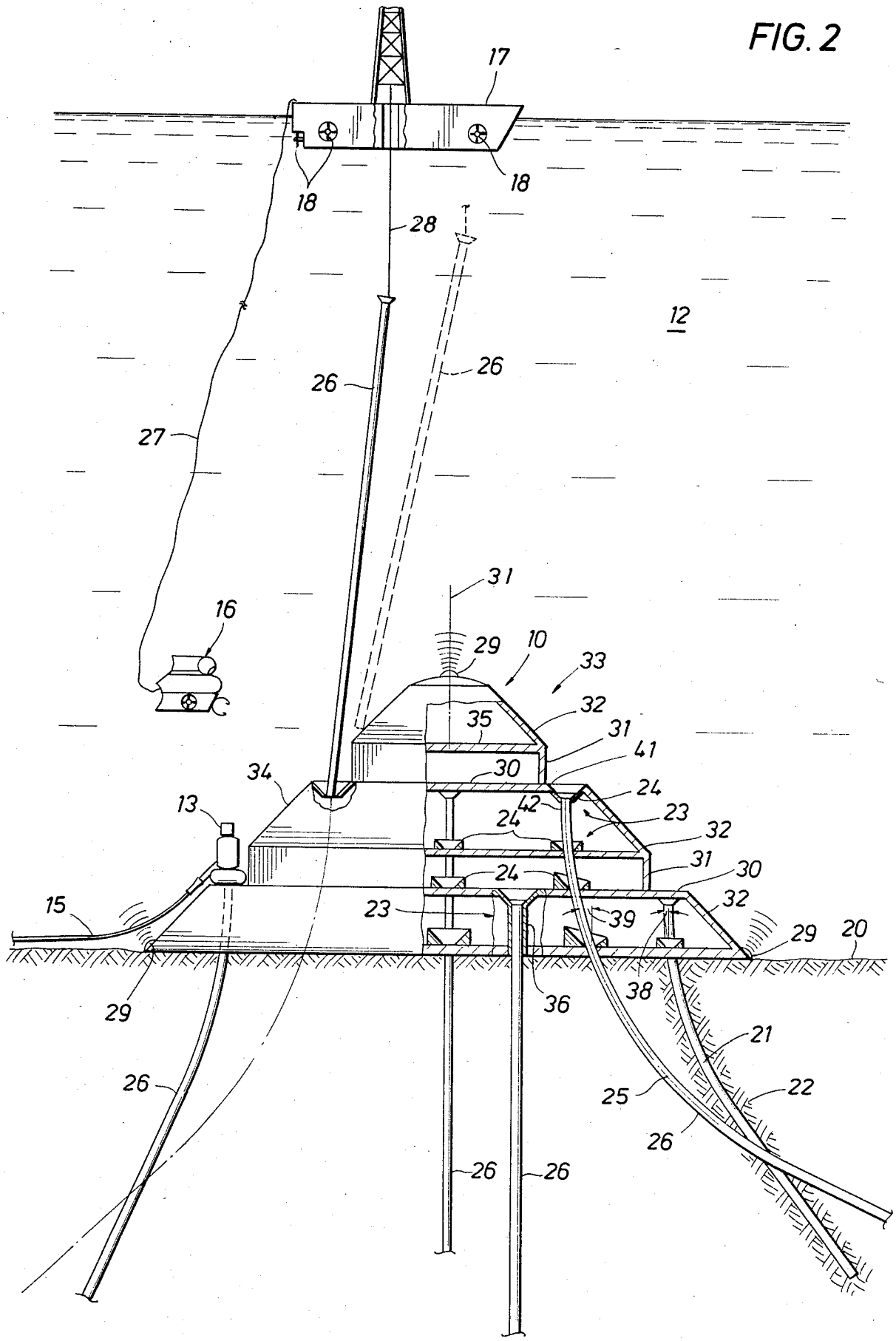
FIG. 2 is a schematic view in cross section taken along lines 2—2 of FIG. 1.

Referring to both FIGS. 1 and 2, a floating vessel 17 is shown floating in a body of water 12. A well conductor template 10 is located beneath said vessel 17, said template 10 resting upon the floor of the bottom of water 20. Whereas a floating vessel 17 is shown, it is recognized that a tension leg platform well known to the art may also be used for the operations to be subsequently described. These operations utilizing a well conductor template 10 are typically conducted in the deeper water depths of the body of water 12.

An observation vehicle 16 is shown positioned adjacent the well conductor template 10 in order to send visual signals through the communication cable 27 to the vessel 17. This visual information is used as an aid in positioning the vessel 17 in order to correctly align a well conductor 26 suspended by a cable 28 from a derrick 19 carried by the vessel 17. The well conductor 26, typically a tubular section having an opening defined therethrough along the longitudinal axis of the section, is shown in FIG. 2 as a straight section. It is recognized, however, that the well conductor 26 may be preformed or prebent to aid the assembly of the well conductor 26 through the well conductor template 10. The well conductor 26 is shown initially contacting the sheathing 34 which forms the upper surface of the well conductor template 10. This sheathing 34 may take the form of plate steel or prestressed concrete sections fabricated and constructed by methods well known to the art.

An underwater wellhead assembly 13 is shown positioned upon a horizontal member 30 of the well conductor template 10. A flow line 15 is shown connected to the underwater wellhead assembly 13. The underwater wellhead assembly 13 can also be mounted on the deck of the vessel 17 with a production riser (not shown) extending downwardly from the vessel 17 to the template 10, in order to transmit reservoir fluids from beneath the well conductor template 10 to the vessel 17 for further processing by methods well known to the art.

A series of sonar transmitters 29 may be located about the well conductor template 10 in order to help position the vessel 17 above the template 10. It is also recognized that a sonar transmitter 29 or TV camera (not shown) may be mounted on the conductor 26 while it is being lowered to aid in guiding it into the subsea template 10.

The configuration of the well conductor template 10 permits easy directional guidance of the well conductors 26 to any of the four sides of the template 10. Note that a circular template or other geometric configuration may also be used. The pyramid shape of the well conductor template 10 prevents mud and silt buildup at the lower elements and also elevates the interior conductors 26 located adjacent or closer to a vertical central axis 37 to allow a greater angle of inclination of the interior conductors 26 when leaving the template 10. For example, once the conductors 26 are installed within the template 10, the conductors 26 located closer to the central axis 37, due to their increase length, can develop an angle of inclination 39 of their lower elements located adjacent the lower elements of the template 10, greater than an angle of inclination 38 developed by the shorter well conductors 26 located further from the vertical axis 37. In an alternative embodiment if different vertical heights are not desired or are not required the top of the template 10 could be flat and not require the sloping sides of the sheathing 34.

Note that at least one of the well conductors 26 is shown extending outwardly and downwardly with respect to the lower elements of the well conductor template 10, although it is recognized that the conductors 26 may be terminated at the base of the template 10.

During installation of the well conductors 26, the upper sheathing 34 of the template 10 forms well conductor movement limiting means 33. These movement limiting means 33 include at least one horizontal member 30 and at least one inclined member 32, an inclined member also including, for example, a vertical member 31 if necessary. The horizontal member 30 forms a planar surface having openings defined therethrough. Landing shoulders 41 are formed around these openings, these landing shoulders 41 typically taking the geometric configuration of funnels in order to assist in lowering the lower end of well conductor 26 down through the template 10. The landing shoulders 41 are operatively engaged to an upper portion of conductor guide means 23.

These conductor guide means 23 are carried by the template 10 and constructed so as to form an opening curved down through the template 10 in order to slideably receive the well conductor 26. These conductor guide means 23 may also be used to bend a straight well conductor 26 as it is forced down through the template 10 such as by an underwater pile driving apparatus (not shown) attached to the upper end of the conductor 26. These means 23 may take the form of discrete guide units 24, such as rings, welded to members of the framework 35 of the well conductor template 10, or these conductor guide means 23 may take the form of a single unitary guide pipe 36 which can be curved and preformed and then secured to the interior of the template 10. If discrete guide units 24 are utilized, they are typically spaced vertically apart in substantial vertical alignment and are deviated horizontally from a vertical alignment so as to define an arcuate center line through the centers of said guide units 24. The guide pipes 36 are also deviated horizontally from a vertical alignment to define an arcuate center line.

The well conductor movement limiting means 33 formed by a substantial portion of the upper surface or sheathing 34 of the well conductor template 10, is arranged during installation of at least one well conductor 26, to prevent that well conductor from downward vertical movement and/or lateral movement toward the vertical central axis 37 of the well template 10. To accomplish this result, the horizontal member 30 is typically operatively connected to an inclined member 32, the arrangement of both members 30 and 32 assisting the installation alignment of the lower end of the well conductor 26 with the open upper end of said conductor guide means 23.

Once the conductor 26 is installed through the template 10, it can be seen to define an arcuate center line 25 through at least a portion of the template 10. A conductor 26 vertical section 42 may be utilized at any convenient point to correctly align the conductor 26 toward a targeted reservoir located beneath the body of the water floor 20. In any event, the conductors 26 are prebent or bent by the template 10 in such a fashion as to have a relatively smooth bore throughout the entire extent thereof. Note that the well template 10 may be installed upon the body of water floor 20 with or without at least some well conductors 26 fabricated within the framework 35 of the template 10. Note that all conductors 26 have a portion curved outwardly, and all conductors 26 also extend downwardly through the well conductor template 10 and are positioned during passage through the template within the plan view periphery of the template 10.

The height of the well conductor template 10 will typically be less than the water depth that the template is submerged in. A conductor 26 may also be used as pile means 21 in order to supply sufficient anchoring means for anchoring the template 10 to the floor of the body of water 12. Means carried by said template 10 for receiving these pile means 21 may take the form of the conducter guide means 23 used to assist in positioning the conductors 26 through the structure 10.

Whether the well conductors 26 are used to assist in well drilling operations or as merely a pile means 21 to anchor the template 10 to the ocean floor 20, it can be seen that the curved conductor guide means 23 can sufficiently deviate the well conductor 26 up to an allowable curvature of 6° without deleterious effects to drilling and/or pile driving operations. Above an angle of 6° chafing of the drillstring (not shown) rotating within a conductor 26 upon the interior wall of the conductor 26 may cause separation of the drillstring with subsequent loss of time during field production development. It is well recognized that curvature angles less than 6° may be used in the fabrication and installation of any well conductor 26 within the template 10.

The method for producing hydrocarbons from a subterranean hydrocarbon-bearing formation located beneath the floor of the body of water 20 can be accomplished by using the aforementioned apparatus in the following manner. First, the well conductor template 10 having a vertical central axis and carrying at least one curved conductor guide 23 means is installed on the floor of the body of water 12. Then, a well conductor 26 is lowered downwardly through the body of water 12. The well conductor 26 eventually contacts the well conductor movement limiting means 33 formed by a substantial portion of the upper surface of the well template 10. Contact of the well conductor 26 with these movement limiting means 33 prevents the conductor 26 from further downward vertical movement and/or further lateral movement toward the vertical central axis 37 of the template 10. At this point, the lower end of the well conductor 26 is aligned with an open upper end of the curved conductor guide means 23. As before, these guide means 23 may take the form of discrete guide units 24 or a guide pipe 36 as discussed earlier.

The step of lowering at least one well conductor 26 downwardly through the body of water 12 includes providing a floating vessel 17 with lowering means 28 such as drill pipe or cable (not shown) well known to the art, to lower the well conductor 26 down through the body of water 12. As the conductor 26 is lowered, the position of the lower end of the conductor 26 may be monitored by the observation vehicle 16 or by a Televison camera (not shown) mounted on the conductor 26, as the lower end approaches the well conductor template 10. A sonar transmitter 29 may also be mounted on the lower end of the conductor 26. The position of the vessel 17 may be adjusted by the actuation of directional positioning thrusters 18 or mooring lines (not shown) so that the lower end of the conductor 26 contacts the well conductor template 10 as close as possible to a desired conductor guide means 23. These guide means 23 define an opening through a substantially horizontal member 30 which forms a portion of the upper surface of the conductor template 10. The position of the vessel 17 and length of the lowering means 28 may be readjusted until the lower end of the well conductor 26 aligns with and enters the opening defined by the conductor guide means 23.

Once the well conductor 26 is aligned with the conductor guide means 23 opening, the well conductor 26 may be extended downwardly with respect to the well conductor template 10 through the conductor guide means 23. The conductor 26 therefore curves outwardly and downwardly through the template 10 in a manner maintaining a relatively smooth bore throughout substantially the entire extent of the conductor 26.

The conductor 26 is curved through the template 10 by providing conductor guide means 23 at a plurality of spaced locations on the conductor template 10 adapted to curve the conductor 26. Extending the conductor 26 into communication with these guide means 23 curves the conductor 26. Of course, the step of curving the conductor 26 may include the step of preforming the desired curvature in the conductor 26 prior to the step of extending the conductor 26 downwardly with respect to the well conductor template 10. As mentioned earlier, the conductor may be curved up to approximately 6° every 100 feet.

In addition to extending one well conductor 26 downwardly with respect to said well conductor template 10, a plurality of well conductors 26 may be extended downwardly into said well template 10, these conductors 26 subsequently spaced at varying distances from the central vertical axis 37 of the template 10. At least one conductor 26 located adjacent the vertical central axis 37 will have a longer length measured through the well template cross section 10 than shorter length conductors 26 located further from the central axis 37 of the template 10, since the well template 10 in the preferred embodiment has a maximum height at its central axis 37. The elements of this longer length conductor which are located adjacent the lower elements of the template 10, will have a greater angle of inclination 39 from the vertical than the shorter length conductors 26 elements which are also located adjacent the lower elements of the template 10. In the preferred embodiment, at least one of the conductors 26 may be extended outwardly and downwardly with respect to the lower elements of the well conductor template 10.

Once the well conductors 26 are installed within the template 10, wells may be drilled via the conductor 26 down through said floor 20 and into fluid communication with hydrocarbon bearing formations (not shown). Formation fluids (not shown) may be produced from these hydrocarbon bearing formations via the well conductor 26.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim as my invention:

1. An anchored submerged marine structure located at the bottom of a body of water for use in the directional drilling of underwater wells from a floating vessel which comprises:

a well conductor template disposed on the floor of said body of water, having a vertical central axis defined therethrough, well conductor movement limiting means formed by a substantial portion of the upper surface of said well conductor template, said surface arranged to prevent, during installation of at least one well conductor, said well conductor from downward vertical movement and lateral movement toward the vertical central axis of said well template, and curved conductor guide means carried by said conductor template and forming an opening curved therethrough, for slideably receiving a well conductor passed downwardly therethrough.

2. The apparatus of claim 1 wherein said curved conductor guide means includes discrete guide units fixedly secured to said template and spaced vertically apart in substantial vertical alignment and being deviated horizontally from said vertical alignment so as to define an arcuate center line through the centers of said guide units.

3. The apparatus of claim 1 wherein said conductor guide means includes a curved preformed guide pipe fixedly secured to the interior of the template.

4. The apparatus of claim 1 wherein said well conductor movement limiting means includes at least one horizontal member and at least one inclined member, said horizontal member forming a planar surface having openings defined therethrough, landing shoulders formed around said openings, said landing shoulders operatively engaged to an upper portion of said conductor guide means, said horizontal member operatively connected to said inclined member, the arrangement of both members assisting the installation alignment of the lower end of a well conductor with the open upper end of said conductor guide means.

5. An anchored submerged marine structure at the bottom of a body of water for use in the directional drilling of underwater wells from a floating vessel, which comprises:

a well conductor template disposed on the floor of said body of water, having a vertical central axis defined therethrough, at least one well conductor through which a well may be drilled, said conductor extending downwardly through said well conductor template, a portion of said conductor being curved outwardly, said conductor positioned within the plan view periphery thereof, said conductor having a relatively smooth bore throughout the entire extent thereof, and well conductor movement limiting means formed by a substantial portion of the upper surface of said well conductor template, said surface arranged to prevent, during installation of at least one well conductor, said well conductor from downward vertical movement and lateral movement towards the vertical central axis of said well template.

6. The apparatus of claim 5 wherein said well conductor template includes a plurality of curved conductor guide means fixedly secured to said template and disposed in spaced vertical arrangement within the plan view periphery of said well template for curving said conductor, with said conductor positioned in and engaging said guide means along the curved bore thereof.

7. The apparatus of claim 5 including a plurality of said well conductors in said template spaced at varying spaced distances from the vertical central axis of said template, at least one of said conductors being located adjacent said vertical central axis of said well conductor template and having a longer length through said well template than shorter length conductors located further from said vertical central axis of said template, said longer length conductor's elements located adjacent the lower elements of said template having a greater angle of inclination from the vertical than said shorter length conductor's elements located adjacent the lower elements of said template, at least one of said conductors extending outwardly and downwardly with respect to the lower elements of said well conductor template.

8. The apparatus of claim 5 wherein said well conductor extends first vertically downwardly with respect to said well conductor template, then curves for the major portion thereof outwardly and downwardly.

9. The apparatus of claim 5 wherein said well conductors extending downwardly with respect to said well conductor template extend along a curved path below said template and into the floor of said body of water.

10. The apparatus of claim 5 wherein said well conductor movement limiting means includes at least one substantially horizontal member and at least one inclined member, said horizontal member forming a planar surface having openings defined therethrough, landing shoulders formed around said openings, said landing shoulders operatively engaged to an upper portion of a curved conductor guide means, said horizontal member operatively connected to said inclined member, the arrangement of both members assisting the installation alignment of the lower end of a well conductor with the open upper end of said curved conductor guide means, said curved conductor guide means fixedly secured to said template and disposed in spaced vertical arrangement within the plan view periphery of said well template for curving said well conductor, with said conductor positioned in and engaging said conductor guide means along the curved bore thereof.

11. A marine structure, adapted to be positioned on the bottom of a body of water, for use in the directional drilling of underwater wells from a floating vessel which comprises:

a substantially rigid well conductor template having a vertical central axis of a height, when assembled, less than the water depth in which such template is to be positioned, means carried by said conductor template for receiving anchoring means for anchoring said template to the floor of said body of water, curved conductor guide means carried by said template and being adapted to slideably receive a well conductor passed downwardly therethrough, and well conductor movement limiting means formed by a substantial portion of the upper surface of said well conductor template, said surface arranged to prevent, during installation of at least one well conductor, said well conductor from downward vertical movement and lateral movement toward the vertical central axis of said well template.

12. A method for producing hydrocarbons from a subterranean hydrocarbon-bearing formation located beneath the floor of a body of water, said method comprising the steps of:

installing a well conductor template, having a vertical central axis, said template carrying at least one curved conductor guide means, on the floor of said body of water above said formation, lowering a well conductor downwardly through said body of water, contacting well conductor movement limiting means formed by a substantial portion of the upper surface of said well template, thereby preventing said well conductor from downward vertical movement and lateral movement toward the vertical central axis of said well template, aligning the lower end of said well conductor with an open upper end of said curved conductor guide means, extending said well conductor downwardly with respect to said well conductor template, through said curved conductor guide means, thereby curving said conductor outwardly and downwardly through said template in a manner maintaining a relatively smooth bore throughout substantially the entire extent of said conductor;

drilling a well via said conductor down through said floor and into fluid communication with said formation; and producing formation fluids from said formation via said well conductor.

13. The method of claim 12 wherein the step of curving said conductor includes the steps of:

providing conductor guide means at a plurality of spaced locations on said conductor template adapted to curve said conductor; and extending said conductor into communication with said guide means thereby curving said conductor through said guide means.

14. The method of claim 12 wherein in addition to the step of extending at least one well conductor downwardly with respect to said well conductor template, extending a plurality of well conductors downwardly in said well template spaced a varying distance from the vertical central axis of said template, at least one of said conductors being located adjacent said vertical central axis of said template, said conductor having a longer length through said well template than shorter length conductors located further from said vertical central axis of said template, said longer length conductor's elements located adjacent the lower elements of said template having a greater angle of inclination from the vertical than said shorter length conductor's elements located adjacent the lower elements of said template, at least one of said conductors extending outwardly and downwardly with respect to the lower elements of said well conductor template.

15. The method of claim 12 wherein the step of lowering at least one well conductor downwardly through said body of water includes:

providing a floating vessel with lowering means to lower said well conductor downwardly through the body of water, monitoring the position of the lower end of said well conductor as the lower end approaches said well conductor template, adjusting the position of said floating vessel so that the lower end of said conductor contacts said well conductor template as close as possible to a desired conductor guide means, said guide means defining an opening through a substantially horizontal planar member forming a portion of the upper surface of said conductor template, and readjusting the position of said vessel and the length of said lowering means until the lower end of said well conductor aligns with and enters said opening defined by said conductor guide means.

16. The method of claim 12 wherein the step of curving said conductor includes the step of preforming the desired curvature in said conductor prior to the step of extending said conductor downwardly with respect to said well conductor template.

17. The method of claim 12 wherein the step of curving said conductor includes the step of continually curving said conductor up to approximately 6° every 100 feet.

* * * * *